US008920225B2

(12) United States Patent
Kang

(10) Patent No.: US 8,920,225 B2
(45) Date of Patent: Dec. 30, 2014

(54) WATER VAPOR VENT STRUCTURE FOR DISHWASHER AND DISHWASHER HAVING THE SAME

(75) Inventor: Myong-Ho Kang, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 1127 days.

(21) Appl. No.: 12/187,686

(22) Filed: Aug. 7, 2008

(65) Prior Publication Data

US 2009/0038653 A1 Feb. 12, 2009

(30) Foreign Application Priority Data

Aug. 10, 2007 (KR) ..... 10-2007-0080907

(51) Int. Cl.
*A47L 15/42* (2006.01)
*A47L 15/48* (2006.01)
*F24F 7/04* (2006.01)

(52) U.S. Cl.
CPC ..... *A47L 15/483* (2013.01); *A47L 15/488* (2013.01)
USPC ..... 454/339; 454/261; 134/105

(58) Field of Classification Search
CPC ..... F24F 7/08; F24F 7/02; A47L 15/486; A47L 15/4291; A47L 15/483
USPC ..... 454/339, 261, 283; 134/105
See application file for complete search history.

(56) References Cited

U.S. PATENT DOCUMENTS 2,731,958 A * 1/1956 Robley ..... 123/573
3,026,628 A * 3/1962 Berger, Sr. et al. ..... 134/108
3,068,877 A * 12/1962 Jacobs ..... 134/99.1
3,588,213 A * 6/1971 Braga ..... 312/228
3,680,940 A * 8/1972 Johansson et al. ..... 312/213
3,876,469 A * 4/1975 Schimke ..... 134/95.2
4,064,888 A * 12/1977 Diebel ..... 134/182
4,175,937 A * 11/1979 Brandau et al. ..... 55/419
4,179,821 A * 12/1979 Herbst et al. ..... 34/235
4,247,158 A * 1/1981 Quayle ..... 312/213
4,709,488 A * 12/1987 Anselmino et al. ..... 34/235
5,211,188 A * 5/1993 Kraus ..... 134/93
7,216,654 B2 * 5/2007 Kang ..... 134/58 DL (Continued)

FOREIGN PATENT DOCUMENTS

FR 2491319 * 4/1982
FR 2491319 A1 * 4/1982

(Continued)

OTHER PUBLICATIONS

Kenji, JP 2000-023893, Jan. 25, 2000, English machine translation.*

(Continued)

*Primary Examiner* — Kang Hu
*Assistant Examiner* — Phillip E Decker
(74) *Attorney, Agent, or Firm* — Ked & Associates, LLP

(57) ABSTRACT

A dishwasher having a water vapor vent structure is provided. The water vapor vent structure may include an outer cover having one or more water vapor vents, and an inner cover detachably mounted to the outer cover and having condensation channels for condensing water vapor. As water vapor is collected and maintained in the condensation channels for a period of time, condensation efficiency may be enhanced, and air quality in a room in which the dishwasher may be maintained at an acceptable level.

18 Claims, 5 Drawing Sheets

(56) References Cited

U.S. PATENT DOCUMENTS

| | | | | |
|---|---|---|---|---|
| 2006/0236556 | A1* | 10/2006 | Ferguson et al. | 34/73 |
| 2007/0261721 | A1* | 11/2007 | Eiermann et al. | 134/107 |
| 2008/0072935 | A1* | 3/2008 | Han et al. | 134/104.2 |

FOREIGN PATENT DOCUMENTS

| | | | | |
|---|---|---|---|---|
| JP | 2000-23893 | * | 1/2000 | A47L 15/42 |
| JP | 2000-023893 | | 1/2000 | |
| JP | 2006-034312 | | 2/2006 | |
| KR | 10-2002-0047870 | | 6/2002 | |
| KR | 10-2006-012317 A | * | 11/2006 | |
| KR | 10-2006-0121317 | * | 11/2006 | |
| KR | 10-2007-0105055 | | 10/2007 | |

OTHER PUBLICATIONS

Shin, KR 10-2006-0121317, Nov. 29, 2006, English machine translation.*
Nakagawa, JP 2000-023893, Jan. 25, 2000, English machine translation.*
Shin, KR 10-2006-0121317 A, Nov. 29, 2006, English machine translation.*
Nakagawa, JP 2000-023893 A, Jan. 25, 2000, English machine translation.*
Korean Office Action dated Sep. 28, 2009.
Korean Office Action dated Sep. 30, 2008.

* cited by examiner

WATER VAPOR VENT STRUCTURE FOR DISHWASHER AND DISHWASHER HAVING THE SAME

RELATED APPLICATION

The present invention relates to subject matter contained in priority Korean Application No. 10-2007-0080907, filed on Aug. 10, 2007, which is herein expressly incorporated by reference in its entirety.

BACKGROUND OF THE INVENTION

1. Field of the Invention

The present invention relates to a dishwasher, and more particularly, to a water vapor vent structure for a dishwasher comprising a condensation member formed of condensation channels or condensation ribs, capable of effectively condensing moisture contained in water vapor by configuring an exhaustion path of water vapor occurring when drying dishes to be long, and capable of reducing condensed water from leaking to outside of the dishwasher.

2. Description of the Background Art

Generally, a dishwasher is a home electronic appliance for washing dishes by a pressure of washing water injected from upper and lower nozzles mounted in a tub.

The conventional dishwasher is provided with a water vapor vent structure comprising: a washing space formed in a body having an opened front surface, and having a hexahedron shaped-cavity therein; a dish rack slidably inserted into the washing space; a nozzle rotatably disposed below the dish rack, and injecting washing water through an injection hole; a sump disposed below the washing space, and containing washing water therein; a washing pump assembly installed at one side of the sump, and having a washing pump connected to a pump body so that washing water can be supplied to the nozzle installed at the end of an injection channel by a pumping process; a heater installed in the sump, and heating washing water inside the sump; a water vapor vent installed at the door, for exhausting water vapor occurring at the time of drying dishes; and a drying fan.

A drying process inside the washing space will be explained.

When a drying process starts after a rinsing process, external water vapor is introduced, and the introduced water vapor passes through dishes. Then, the external water vapor passing through the dishes are exhausted through the water vapor vent as the drying fan rotates. More specifically, as water vapor passing through the washing space absorbs moisture contained in the dishes, the dishes become dry.

However, the conventional dishwasher has the following problems. Since water vapor occurring from dishes has a short exhaustion path, only a small amount of moisture contained in the water vapor is condensed, whereas most of moisture is exhausted out of the dishwasher in the form of vapor. Accordingly, humidity of an indoor room where the dishwasher is installed increases, which causes a user's discomfort.

Furthermore, even if condensed water occurring at the time of drying dishes is formed at the water vapor vent, the condensed water flows down outside the door, without flowing into the dishwasher. This may cause the door including the water vapor vent to have a degraded appearance, or an installation surface for the dishwasher to be unsanitary.

Furthermore, even when condensed water condensed at the water vapor vent flows into the dishwasher, due to no sealing member for preventing condensed water from flowing into the door, the condensed water flows into the door. This may cause fungus to occur in the door.

SUMMARY OF THE INVENTION

Therefore, it is one object of the present invention to provide a water vapor vent structure for a dishwasher comprising a condensation member capable of reducing condensed water from being condensed at a water vapor vent by configuring a water vapor channel to be long, and a dishwasher having the same.

It is another object of the present invention to provide a water vapor vent structure for a dishwasher comprising a condensed water leakage reducing means capable of reducing condensed water from being condensed at a water vapor vent, and capable of flowing condensed water condensed at the water vapor vent into a dishwasher, and a dishwasher having the same.

It is still another object of the present invention to provide a water vapor vent structure for a dishwasher comprising a sealing member installed at a part adjacent to a water vapor vent, the sealing member for reducing condensed water condensed at the water vapor vent from flowing into a door while flowing into a dishwasher, and a dishwasher having the same.

To achieve these and other advantages and in accordance with the purpose of the present invention, as embodied and broadly described herein, there is provided a water vapor vent structure for a dishwasher, comprising: an outer cover having one or more water vapor vents; and an inner cover detachably mounted to the outer cover, and having condensation channels for condensing water vapor.

Here, the condensation channel is configured to have a width that becomes narrower along a moving direction of water vapor.

Under the configuration, an exhaustion path of water vapor is made to be long, and an amount of water vapor to be condensed increases.

At the inner cover, formed are a water vapor inlet for introducing water vapor into the condensation channel, and a condensed water outlet for discharging condensed water occurring from the condensation channel. That is, due to the water vapor inlet and the water vapor vent, condensed water can easily return into the dishwasher.

Preferably, an exit of the condensed water outlet is formed to be downwardly inclined.

It is effective to symmetrically form the condensation channels based on a vertical line passing through the center of the inner cover. If the condensation channels are asymmetrically formed each other, condensed water is concentrated on one of the two condensation channels. This may cause condensed water not to be effectively discharged. Accordingly, it is preferable to symmetrically form the condensation channels.

The water vapor vent is formed to be inclined towards outside of the outer cover. More concretely, as the water vapor vent is formed to be upwardly inclined based on a moving direction of water vapor, water vapor can be smoothly exhausted. Furthermore, even if condensed water is condensed at the water vapor vent, the condensed water is reduced from flowing outside the water vapor vent.

Here, the condensation channel is formed on either an inner surface or an outer surface of the inner cover, or both of them. Under this configuration, even if water vapor flows between the outer cover and the inner cover, the water vapor can be condensed.

The condensation channel is implemented in plurality in number, and water vapor is introduced through a lowest condensation channel. Under the configuration that water vapor occurring when drying dishes is firstly introduced to the lowest condensation channel, water vapor having a relatively small density can be condensed by using a principle that water vapor having a relatively small density tends to ascend.

According to another aspect of the present invention, there is provided a water vapor vent structure for a dishwasher, comprising: an outer cover having one or more water vapor vents; an inner cover detachably mounted to the outer cover; and a condensation member mounted to the inner cover, and having a plurality of condensation ribs for condensing water vapor, wherein the condensation ribs are formed on either an inner surface or an outer surface of the condensation member, or both of them.

Here, a condensation member mounting portion for mounting the condensation member is formed at the inner cover.

Since the condensation member is detachably mounted to the inner cover, the condensation member or the inner cover can be easily cleaned. Furthermore, since a condensation channel is formed between the condensation ribs having a certain height, water vapor can be condensed with high efficiency.

A water vapor inlet and a condensed water outlet communicated with each other are formed at the condensation member mounting portion. Under this configuration, condensed water occurring from water vapor introduced into the water vapor inlet is discharged through the condensed water outlet. In order to smoothly discharge condensed water, the condensed water outlet is preferably formed below the water vapor inlet. Here, water vapor may be introduced through the condensed water outlet.

Some of the condensation ribs are formed to be downwardly inclined towards both sides of the condensation member. The reason is in order to downwardly flow condensed water by gravity along the surface of the ribs.

A lowest condensation rib among the condensation ribs is communicated with the water vapor inlet and the condensed water outlet. The reason is in order to condense water vapor by using a principle that water vapor having a relatively small density tends to ascend.

The condensation ribs are formed to be inclined so that condensed water occurring from the condensation member can flow towards the condensed water outlet.

Here, the water vapor vent is formed to be upwardly inclined towards outside of the outer cover. Accordingly, even if condensed water is formed at the water vapor vent, the condensed water is reduced from flowing down outside the water vapor vent.

According to still another aspect of the present invention, there is provided a water vapor vent structure for a dishwasher, comprising: an inner cover having a condensation channel or a condensation rib for condensing water vapor; and an outer cover detachably mounted to outside of the inner cover, and having a water vapor vent for exhausting water vapor, wherein a condensed water leakage reducing means for reducing condensed water from leaking to outside of the outer cover is formed at the water vapor vent.

Here, the water vapor vent is formed to be upwardly inclined towards outside of the outer cover.

Under this configuration, even if condensed water is condensed at an upper part or a lower part of the water vapor vent, the condensed water can be introduced into the dishwasher.

Here, the condensed water leakage reducing means is implemented as a protruding portion protruding from a lower end of the water vapor vent, or a rounded portion formed at an upper end of the water vapor vent. Due to the rounded portion, condensed water condensed at the upper end of the water vapor vent can be re-introduced into the dishwasher along an upper part of the water vapor vent. Even if condensed water condensed at the rounded portion falls down, the condensed water is reduced from flowing outside of the dishwasher due to the protruding portion. Preferably, the protruding portion is extending more than the rounded portion towards a front side of the water vapor vent.

Between the inner cover and the outer cover, formed is a sealing member for preventing water vapor from flowing therebetween.

Here, the sealing member is disposed above and below the water vapor vent, respectively. The sealing member disposed at an upper part of the water vapor vent serves to seal relatively light water vapor, whereas the sealing member disposed at a lower part of the water vapor vent serves to seal relatively heavy condensed water.

To achieve these and other advantages and in accordance with the purpose of the present invention, as embodied and broadly described herein, there is also provided a dishwasher having a water vapor vent structure, comprising: a tub having a washing space therein; and a door rotatably mounted to a front surface of the tub, wherein a water vapor vent structure having condensation channels or condensation ribs is formed in the door.

Here, the condensation channel or the condensation rib is formed to have a labyrinth shape so that an exhaustion path of water vapor can be configured to be long.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to the preferred embodiments of the present invention, examples of which are illustrated in the accompanying drawings. Detailed explanation about well-known functions or configurations will be omitted so as to implement the present invention more explicitly.

Figure 1:
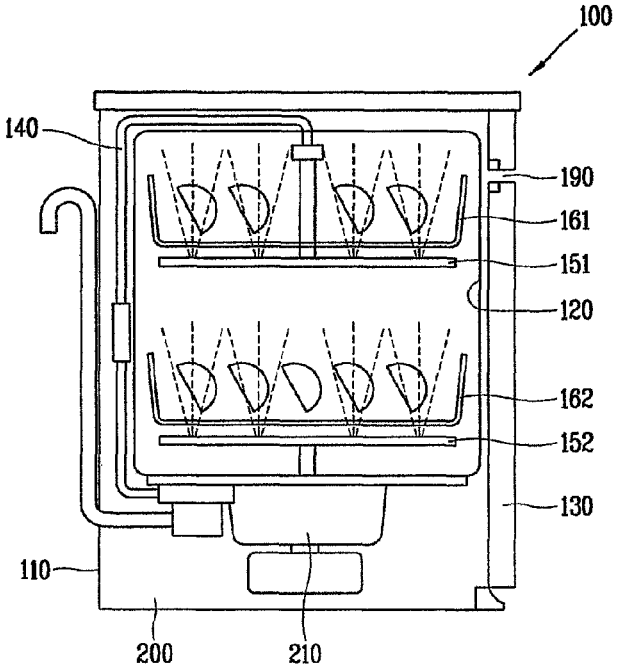
FIG. 1 is a side sectional view of a dishwasher according to the present invention.

FIG. 1 is a side sectional view of a dishwasher according to the present invention.

As shown in FIG. 1, a dishwasher 100 according to the present invention comprises: a base 200; a cabinet 110 disposed above the base 200; a washing space 120 installed in the cabinet 110; upper and lower dish racks 161 and 162 disposed in the washing space 120, and on which dishes are disposed; and a sump 210 disposed below the washing space 120, and containing washing water therein; a washing pump (not shown) for pumping washing water to the sump 210; an injection channel 140 for injecting washing water pumped by the pump to the dish racks 161 and 162; injection nozzle 151 and 152; and a door 130 for opening and closing one surface of the dishwasher 120.

The injection nozzles are composed of an upper injection nozzle 151 for injecting washing water to dishes received in the upper dish rack 161, and a lower injection nozzle 152 for injecting washing water to dishes received in the lower dish rack 162.

At one side of the door 130, formed is a water vapor vent 190 for exhausting water vapor occurring at the washing space 120 when drying dishes.

Figure 2:
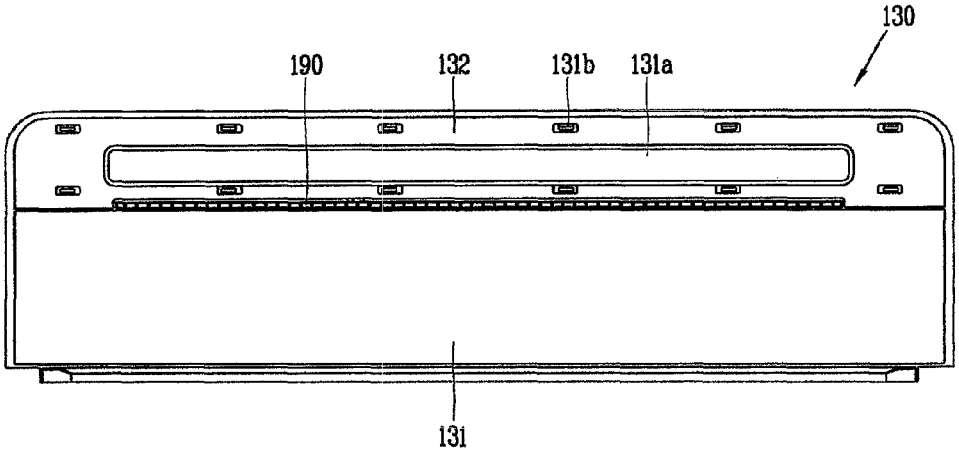
FIG. 2 is a view of a door of the dishwasher of FIG. 1.
Figure 3:
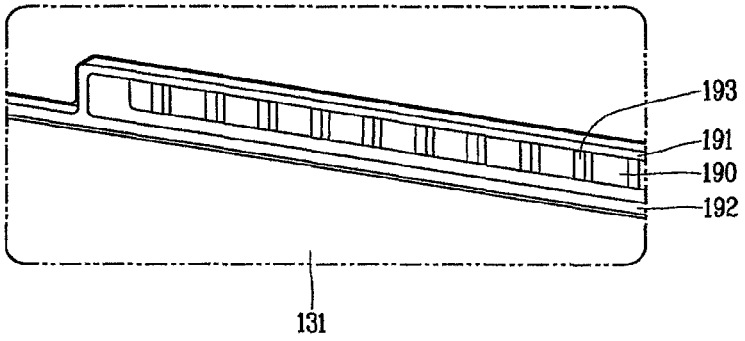
FIG. 3 is a partially enlarged view of a water vapor vent of the door of FIG. 2.

FIG. 2 is a view of a door of the dishwasher of FIG. 1, and FIG. 3 is a partially enlarged view of a water vapor vent of the door of FIG. 2.

More concretely, FIG. 2 shows a closed door 130 viewed from the front side of the dishwasher 100. Here, the door 130 may be an upper door of a door composed of upper and lower doors, and may be an upper portion of one integrated door. The door composed of upper and lower doors is suitable for a small dishwasher, and demands therefor increase due to a small space required when opening the door.

As shown in FIG. 2, a door window 132 formed of a transparent material is mounted to an upper end of the door 130, and a door frame 131 is attached to a lower portion of the door window 132. Each kind of shapes for enhancing appearance of the door 130 may be formed at the door frame 131.

A through hole 131*a* is formed at the door 130 so that a user can see inside of the dishwasher 100 through the door window 132. A plurality of door window coupling portions 131*b* are formed at the periphery of the through hole 131*a*. Hooks (not shown) of the door window 132 are coupled to the door window coupling portions 131*b*.

A plurality of the water vapor vents 190 are formed below the door window 132. As shown in FIG. 3, the water vapor vents 190 implement a shape of a ladder laid down on the floor.

The water vapor vents 190 are formed by upper and lower horizontal members 191 and 192, and a plurality of vertical members 193. The vertical members 193 prevent water vapor from being intensively exhausted through the water vapor vents 190. That is, if the vertical members 193 are not implemented, one water vapor vent 190 is formed, which causes water vapor to be exhausted at one time. This may cause the humidity of a kitchen where the dishwasher 100 is installed, etc. to be abruptly increased.

Due to the vertical members 193, water vapor can be exhausted in two directions by being diverged after colliding to the vertical members 193. Here, some of the water vapor may be condensed. Furthermore, the vertical members 193 prevent foreign materials from being introduced into the water vapor vents 190.

Figure 4:
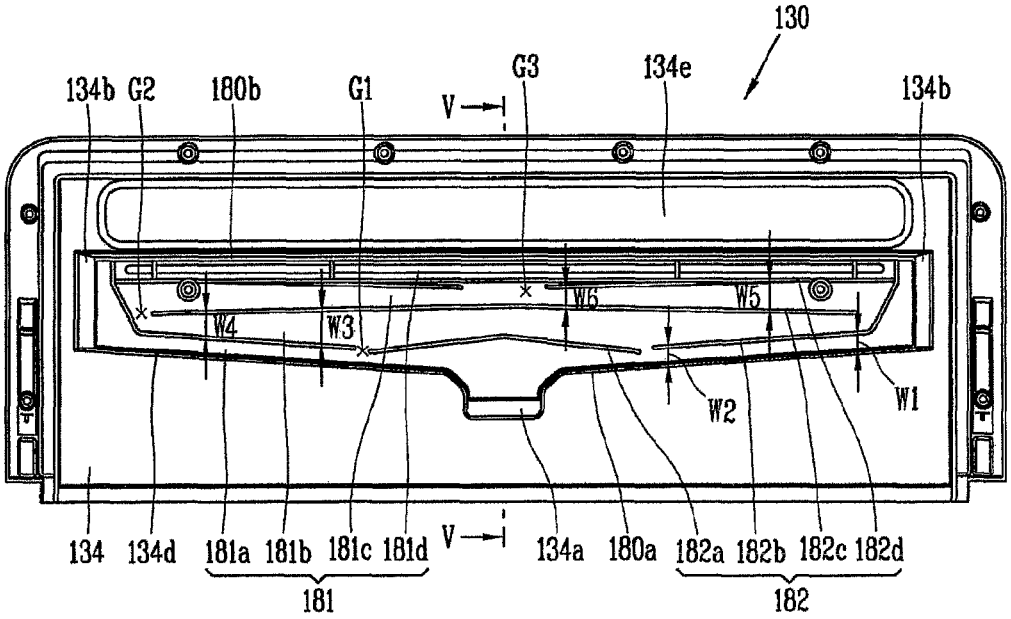
FIG. 4 is a view showing an inner surface of the door of the dishwasher of FIG. 2.

FIG. 4 is a view showing an inner surface of the door of the dishwasher of FIG. 2.

As shown, inner components of the door 130 include an inner cover 134, and a condensation member 180 formed at the inner cover 134.

The inner cover 134 is provided with a through hole 134*e* corresponding to the through hole 131*a* of the door frame 131, and an inner door window 136 is mounted to the through hole 134*e* of the inner cover 134. A door window through which a user can see inside of the dishwasher 100 is implemented as a double-window composed of the outer door window 132 and the inner door window 136. Since water used to wash dishes in the dishwasher 100 has a very strong injection force, the door window may be damaged by the injected water. Accordingly, the door window is implemented as a double-window.

A condensation member mounting portion 134*d* for detachably mounting the condensation member 180 is provided below the through hole 134*e* of the inner cover 134. Preferably, the condensation member mounting portion 134*d* is formed at the inner cover 134 in a concaved manner. The reason is in order to obtain a space where water vapor stays for a long time to be condensed.

The condensation member mounting portion 134*d* has an edge consistent to an outer periphery of the condensation member 180, and is long extending in a width direction of the door 130. Water vapor inlets 134*b* are facing each other at both sides of the condensation member mounting portion 134*d* in a longitudinal direction.

The water vapor inlets 134*b* serve to introduce water vapor occurring at the time of drying dishes thereinto, and are formed to be inclined towards a central part of the condensation member mounting portion 134*d*.

A lower end of the condensation member mounting portion 134*d* is downwardly inclined towards a central part of the condensation member mounting portion 134*d*, thereby allowing condensed water to flow down along the inclined surface. A condensed water outlet 134*a* for discharging condensed water is formed at a central part of the lower end of the condensation member mounting portion 134*d*.

The condensed water outlet 134*a* is communicated with the water vapor inlets 134*b*, and an exit thereof is formed to be downwardly inclined towards a lower side of the door 130. Accordingly, condensed water can be discharged without an additional discharging means.

Condensation channels 181 or condensation ribs 182 are formed at the condensation member 180 mounted to the condensation member mounting portion 134*d*. The condensation channels 181 may be concavely formed on the surface of the condensation member 180, and the condensation ribs 182 may be protrodingly formed on the surface of the condensation member 180. Accordingly, the condensation channels 181 may be formed between the condensation ribs 182.

The condensation rib 182 is formed in plurality in number from a lower side to an upper side of the condensation member 180. The condensation ribs 182 are formed to have different inclination angles and shapes. Preferably, the condensation ribs 182 are formed to be symmetrical to each other based on a virtual vertical line passing through the center of the condensation member 180. Since the condensation ribs 182 are formed to be symmetrical to each other, water vapor is prevented from being excessively condensed at one part of the condensation member 180.

The condensation ribs 182 include a first condensation rib 182*a* formed at the lowest side, a second condensation rib 182*b* spaced from the end of the first condensation rib 182*a* , a third condensation rib 182*c* disposed above the first condensation rib 182*a* and the second condensation rib 182*b*, and a fourth condensation rib 182*d* disposed above the third condensation rib 182*c* as one unit.

The first condensation rib 182*a* is disposed above the condensation water outlet 134*a*. The center of the first condensation rib 182*a* and the center of the condensed water outlet 134*a* are disposed on nearly the same vertical line. The first condensation rib 182*a* has a an inverted V-shape. More concretely, the first condensation rib 182*a* is downwardly inclined towards the water vapor inlets 134*b* formed at both sides of the condensation member 180, or at both sides of the condensation member mounting portion 134*d* , so that condensed water occurring when water vapor collides onto the surface of the first condensation rib 182*a* can flow to both ends of the first condensation rib 182*a*.

The second condensation ribs 182*b* are symmetrically formed at both sides of a vertical line passing through the center of the condensation member 180. Each of the second condensation ribs 182*b* is formed at one side of the first condensation rib 182*a* with a certain distance from the end of the first condensation rib 182*a*.

One end of the second condensation rib 182*b* is disposed next to one end of the first condensation rib 182*a* , and another end of the second condensation rib 182*b* is connected to one end of the fourth condensation rib 182*d*. In order to implement this configuration, the second condensation rib 182*b* has a shape of about 'L', and has an angle of about 120° between horizontal and vertical parts. The horizontal part of the second condensation rib 182*b* is downwardly inclined towards the condensed water outlet 134*a* , and the vertical part thereof is also downwardly inclined with an inclination angle steeper than that of the horizontal part.

A first condensation channel 181*a* is formed by the first condensation rib 182*a* , the second condensation rib 182*b* , and a lower edge 180*a* of the condensation member 180. The first condensation channel 181*a* is communicated with the water vapor inlets 134*b* and the condensed water outlet 134*a* , and serves as a channel through which water vapor firstly passes.

Here, water vapor introduced into the dishwasher through the water vapor inlets 134*b* passes through the first condensation channel 181*a* downwardly inclined towards the condensed water outlet 134*a*. At this time, the water vapor collides with the first condensation rib 182*a*, the second condensation rib 182*b*, or the lower edge 180*a* of the condensation member 180, thereby occurring condensed water. The condensed water is discharged into the dishwasher through the condensed water outlet 134*a* along the inclination of the first condensation channel 181*a*.

Water vapor tends to upwardly move due to its small density, and flows to a space where the third condensation rib 182*c* is formed, through a first gap (G1) formed between one end of the first condensation rib 182*a* and one end of the second condensation rib 182*b*.

Water vapor occurring during a drying process may be introduced not only into the water vapor inlets 134*b*, but also into the condensed water outlet 134*a*. Water vapor introduced into the condensed water outlet 134*a* is condensed by colliding with the first condensation rib 182*a*, and flows to right and left sides of the first condensation rib 182*a* along a lower surface of the first condensation rib 182*a*. Other water vapor having not been condensed flows to right and left sides of the first condensation channel 181*a*, and flows along the first condensation channel 181*a* or is introduced into the first gap (G1).

Here, it is effective for the first condensation channel 181*a* to have a width gradually narrowed along a moving direction of water vapor (indicated by the arrows in FIG. 4). That is, the first condensation channel 181*a* is formed to have an inlet side width (W1) wider than that of an outlet side width (W2). Under this configuration, a bottle neck phenomenon may occur at an outlet side of the first condensation channel 181*a*. This may cause water vapor to stay at the first condensation channel 181*a* for a long time to be condensed.

The third condensation rib 182*c* is integrally formed, and has a reversed V-shape in a similar manner as the first condensation rib 182*a*. However, the third condensation rib 182*c* has an inclination angle much gentler than that of the first condensation rib 182*a*. The end of the third condensation rib 182*c* is spaced from the vertical part of the second condensation rib 182*b*, thereby forming a second gap (G2).

Here, a second condensation channel 181*b* is formed by an upper surface of the first condensation rib 182*a*, an upper surface of the second condensation rib 182*b*, and a lower surface of the third condensation rib 182*c*. Water vapor having passed through the first gap (G1) is introduced into the second condensation channel 181*b*. An inlet side width (W3) of the second condensation channel 181*b* closer to the first gap (G1) is wider than an outlet side width (W4) of the second condensation channel 181*b* closer to the second gap (G2). Since the width of the second condensation channel 181*b* becomes narrower along a moving direction of water vapor, a bottle neck phenomenon may occur at an outlet side of the second condensation channel 181*b*. This may cause water vapor to stay at the second condensation channel 181*b* for a long time to be condensed.

The fourth condensation rib 182*d* is disposed above the third condensation rib 182*c*, and is symmetrically formed at both sides of a vertical line passing through the center of the condensation member 180. Here, the fourth condensation rib 182*d* is formed to be downwardly inclined towards the vertical line of the condensation member 180. A third gap (G3) is formed between the fourth condensation ribs 182*d*. The third gap (G3) is wider than the first gap (G1) and the second gap (G2) so as to increase an amount of water vapor that moves towards the water vapor vent 190.

A third condensation channel 181*c* is formed between an upper surface of the third condensation rib 182*c* and a lower surface of the fourth condensation rib 182*d*. Water vapor introduced into the second gap (G2) flows along the third condensation channel 181*c*, and then is introduced into the third gap (G3). Here, an inlet side with (W5) of the third condensation channel 181*c* is wider than an outlet side width (W6) due to the same reason aforementioned in the first and second condensation channels 181*a* and 181*b*.

A fourth condensation channel 181*d* is formed by the fourth condensation rib 182*d*, and an upper edge 180*b* of the condensation member 180. Water vapor introduced into the third gap (G3) flows along the fourth condensation channel 181*d*, and then is exhausted from the water vapor vent 190. Here, the fourth condensation channel 181*d* is provided with a through hole (not shown) for passing water vapor to the water vapor vent 190.

The condensation channels 181 or the condensation ribs 182 may be integrally formed with the inner cover 134. A larger number of condensation channels 181 and condensation ribs 182 may be formed so as to increase condensing efficiency. In this case, it is important to configure that firstly introduced water vapor can pass through the lowest condensation channel.

Here, the condensation channels 181, or the condensation ribs 182 of the condensation member 180 serve not only to condense moisture included in water vapor and discharge the condensed water, but also to return water drops splashed onto the door 130 into the dishwasher 100. That is, the condensation channels 181 or the condensation ribs 182 of the condensation member 180 serve to discharge out condensed water or washing water.

Figure 5:
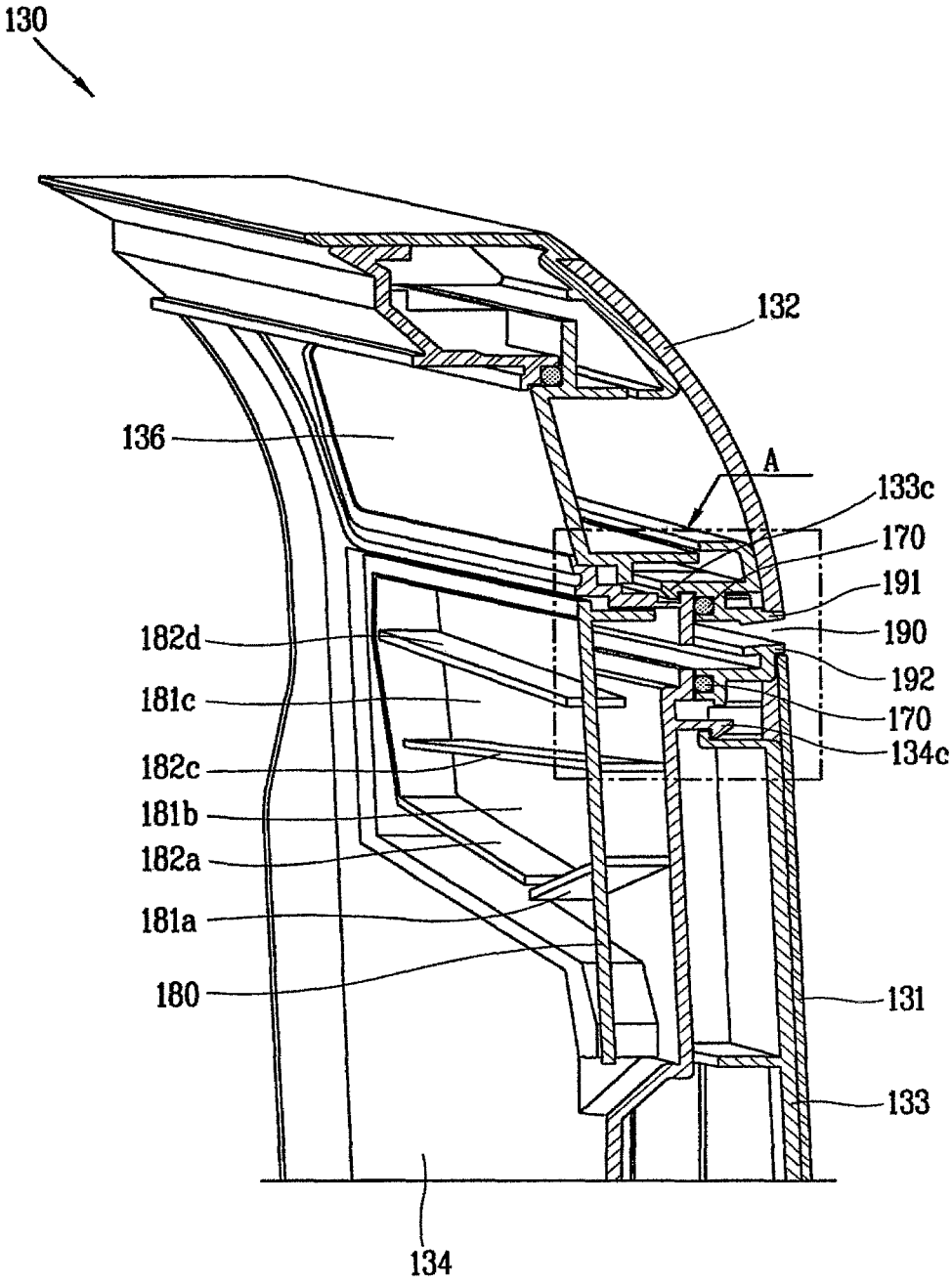
FIG. 5 is a sectional view taken along line 'V-V' in FIG. 4.

FIG. 5 is a sectional view taken along line 'V-V' in FIG. 4.

As shown, the door 130 includes an inner cover 134, an outer cover 133, and a door frame 131. The inner cover 134 is detachably mounted to the outer cover 133.

The condensation channels 181 or the condensation ribs 182 may be formed on either an inner surface or an outer surface of the condensation member 180, or on both an inner surface and an outer surface thereof. Accordingly, even if water vapor is introduced between the outer cover 133 and the inner cover 134, the water vapor can be condensed. Furthermore, when the condensation channels 181 or the condensation ribs 182 are formed on two surfaces of the condensation member 180, any surface of the condensation member 180 can be mounted to the condensation member mounting portion 134*d*. This enhances a user's convenience.

The water vapor vent 190 is formed at the outer cover 133, and a sealing member 170 is mounted at a rear side of the water vapor vent 190. A shape of the water vapor vent 190, and a mounting position for the sealing member 170 will be explained in more detail with reference to FIGS. 6 and 7.

Figure 6:
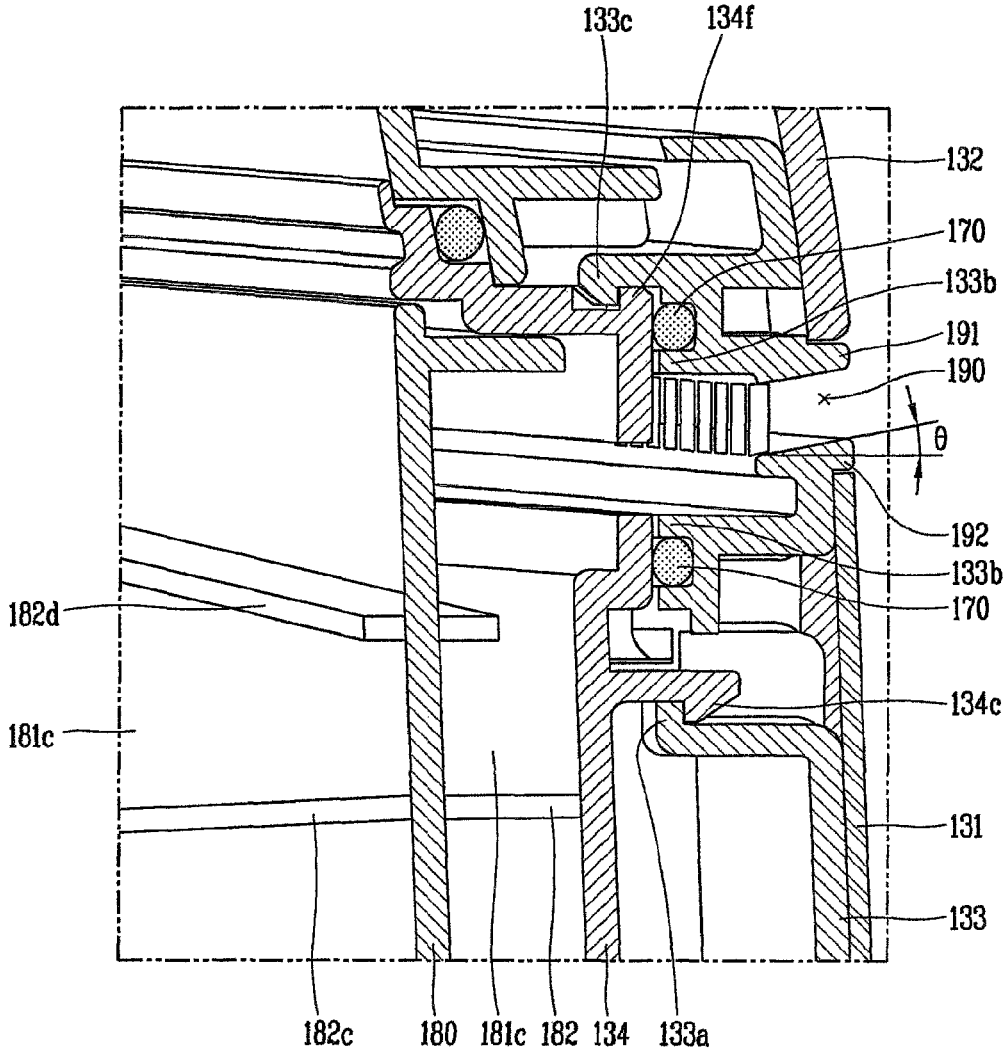
FIG. 6 is an enlarged view of a part, 'A' in FIG. 5.
Figure 7:
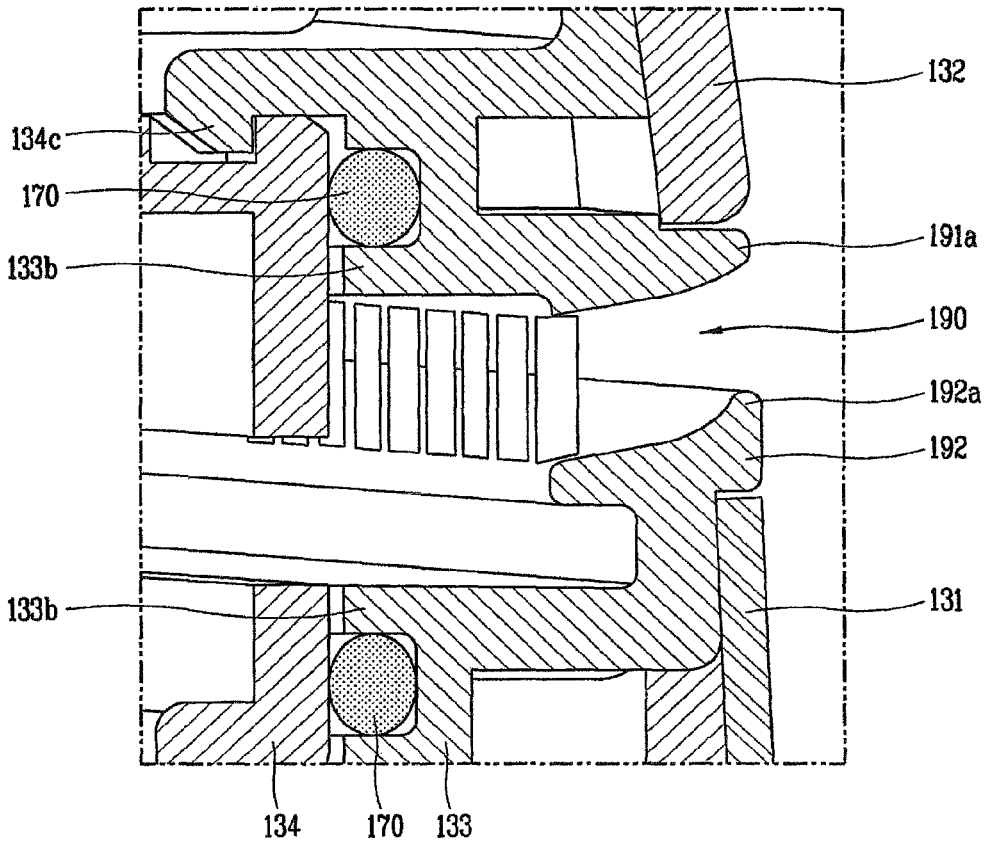
FIG. 7 is an enlarged view of a water vapor vent of FIG. 6.

FIG. 6 is an enlarged view of a part, 'A' in FIG. 5, and FIG. 7 is an enlarged view of a water vapor vent of FIG. 6.

As shown in FIG. 6, the inner cover 134 and the outer cover 133 are detachably coupled to each other by hooks 133*c* and 134*c*. More concretely, the hook 133*c* of the outer cover 133 is locked to a locking jaw 134*f* of the inner cover 134, whereas the hook 134*c* of the inner cover 134 is locked to a locking jaw 133*a* of the outer cover 133. In this manner, the outer cover 133 and the inner cover 134 are coupled to each other.

Here, the hooks 133*c* and 134*c* may be formed at one of the inner cover 134 and the outer cover 133, and the locking jaws 133*a* and 134*f* may be formed at another of the inner cover 134 and the outer cover 133.

The sealing member 170 is mounted to a coupling part between the outer cover 133 and the inner cover 134 in a pressed state. For mounting of the sealing member 170, a sealing member mounting portion 133*b* may be formed at the outer cover 133. Here, the sealing member mounting portion 133*b* may be formed at the inner cover 134.

The sealing member 170 is mounted at upper and lower sides of the water vapor vent 190. The sealing member 170 disposed above the water vapor vent 190 serves to prevent water vapor having a relatively small density from being introduced between the outer cover 133 and the inner cover 134. On the contrary, the sealing member 170 disposed below the water vapor vent 190 serves to prevent condensed water having a relatively large density from being introduced between the outer cover 133 and the inner cover 134.

The water vapor vent 190 is upwardly inclined towards outside of the outer cover 133. More concretely, the upper horizontal member 191 or the lower horizontal member 192 of the water vapor vent 190 has an upward inclination angle (Θ) based on a horizontal line. The upward inclination angle (Θ) allows light water vapor to be smoothly exhausted from the water vapor vent 190, but prevents condensed water formed at the end of the water vapor vent 190 from flowing out via the water vapor vent 190.

That is, even if condensed water is formed at the end of the water vapor vent 190, due to the inclination angle of the water vapor vent 190, the condensed water is again collected into the dishwasher 100 by flowing in a direction reverse to a moving direction of water vapor. Preferably, the upward inclination angle (Θ) is approximately 15°.

May be further formed at the water vapor vent 190, a condensed water leakage reducing means for reducing condensed water formed at the end of the water vapor vent 190 from flowing out.

Referring to FIG. 7, the condensed water leakage reducing means is implemented as at least one of a protruding portion 192*a* protrudingly formed at the lower horizontal member 192, and a rounded portion 191*a* formed at the upper horizontal member 191 of the water vapor vent 190.

The rounded portion 191*a* is formed by rounding the edge of the upper horizontal member 191 of the water vapor vent 190. Due to the rounded portion 191*a*, condensed water can flow into the water vapor vent 190, again.

Furthermore, when condensed water formed at the rounded portion 191*a* drops without flowing into the water vapor vent 190, the condensed water is prevented from flowing outside the water vapor vent 190, due to the protruding portion 192*a* of the lower horizontal member 192 of the water vapor vent 190.

Here, the protruding portion 192*a* is a kind of barrier for preventing condensed water from flowing outside the water vapor vent 190. In order to implement more enhanced effects of the protruding portion 192*a*, the protruding portion 192*a* is preferably more extending towards outside of the water vapor vent 190 than the rounded portion 191*a*. That is, the protruding portion 192*a* is formed to be more protruding than the rounded portion 191*a*, so that condensed water formed at the rounded portion 191*a* can be collected at an inner side of the protruding portion 192*a* while dropping. Accordingly, the condensed water is prevented from flowing outside the water vapor vent 190 by passing through the protruding portion 192*a*.

The water vapor vent structure according to the present invention may be applied not only to a large dishwasher, but also to a small compact type of dishwasher.

The foregoing embodiments and advantages are merely exemplary and are not to be construed as limiting the present invention. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A dishwasher, comprising:

a tub having a washing space therein; and a door rotatably provided at a front of the tub, the door comprising:

an outer cover;

an inner cover detachably mounted to the outer cover, wherein the inner cover includes a plurality of condensation channels formed therein, wherein widths of the plurality of condensation channels become narrower along a water vapor moving direction;

first and second water vapor inlets respectively formed at two opposite peripheral ends of the inner cover, wherein the first and second water vapor inlets are each connected to a corresponding condensation channel of the plurality of condensation channels arranged at a bottom position of the plurality of condensation channels such that the first and second water vapor inlets are configured to guide water vapor from an interior of the dishwasher to the corresponding condensation channel;

a condensed water outlet provided at a central portion of the inner cover so as to be physically separated from the first and second water vapor inlets, wherein the condensed water outlet is configured to receive water vapor from the first and second water vapor inlets via the corresponding condensation channel and drain the received water vapor to an interior of the dishwasher; and one or more water vapor vents provided on the outer cover and exhausting water vapor, each of the one or more water vapor vents comprising:

upper and lower horizontal members and a plurality of vertical members positioned therebetween partially impeding a flow of water vapor through the water vapor vent, wherein the first and second water vapor inlets are disposed at two opposite ends of the plurality of condensation channels formed in the inner cover, and wherein the condensed water outlet is disposed beneath a lowermost of the plurality of condensation channels.

2. The dishwasher of claim 1, wherein the plurality of condensation channels are symmetrical to each other with respect to a vertical line passing through a center of the inner cover.

3. The dishwasher of claim 1, wherein the plurality of condensation channels is formed on an inner surface of the inner cover, on an outer surface of the inner cover, or on both the inner and outer surfaces of the inner cover.

4. The dishwasher of claim 1, wherein water vapor is introduced into the plurality of condensation channels through the lowermost of the plurality of condensation channels.

5. The dishwasher of claim 1, further comprising a condensed water leakage reducer comprising a protrusion that protrudes outward from a lower end of the water vapor vent.

6. The dishwasher of claim 5, wherein the condensed water leakage reducer comprises a rounded portion formed at an upper end of the water vapor vent.

7. The dishwasher of claim 6, wherein the protrusion extends further beyond a front end of the water vapor vent than the rounded portion.

8. The dishwasher of claim 1, further comprising a seal provided between the inner cover and the outer cover, wherein the seal prevents water vapor from flowing between the inner cover and the outer cover.

9. The dishwasher of claim 8, wherein the seal is disposed both above and below the water vapor vent.

10. The dishwasher of claim 1, wherein at least one of the upper horizontal member or the lower horizontal member extends at an upward incline from an interior end toward an exterior end thereof, with an upward inclination angle of the lower horizontal member being greater than that of the upper horizontal member, and wherein at least one protrusion protrudes from the lower horizontal member.

11. The dishwasher of claim 1, wherein the first and second water vapor inlets are provided at positions corresponding to a top position of the interior of the dishwasher such that water vapor circulated by convection flows into the first and second water vapor inlets.

12. A dishwasher of claim 1, wherein the corresponding condensation channel is downwardly inclined from the first and second water vapor inlet toward the condensed water outlet.

13. A dishwasher, comprising:

a tub having a washing space therein; and a door rotatably provided at a front surface of the tub, the door, comprising:

an outer cover;

an inner cover detachably mounted to the outer cover and comprising a condensation panel mounting portion;

a condensation panel mounted on the condensation channel mounting portion, the condensation panel including a plurality of condensation ribs for condensing water vapor, wherein the plurality of condensation ribs are formed on an inner surface of the condensation panel, on an outer surface of the condensation panel, or on both the inner and outer surfaces of the condensation panel such that the plurality of condensation ribs form a plurality of condensation channels; and one or more water vapor vents provided on the outer cover and exhausting water vapor, each of the one or more water vapor vents comprising:

upper and lower horizontal members and a plurality of vertical members positioned therebetween partially impeding a flow of water vapor through the water vapor vent, wherein the condensation panel mounting portion comprises:

first and second water vapor inlets formed at two opposite outer peripheral portions of the condensation panel, wherein the first and second water vapor inlets are connected to one condensation channel of the plurality of condensation channels, the one condensation channel being arranged at a lowermost position of the plurality of condensation channels such that the first and second water vapor inlets are configured to guide water vapor from an interior of the dishwasher to the one condensation channel; and a condensed water outlet disposed at a central portion of the inner cover so as to be physically separated from the first and second water vapor inlets, wherein the condensed water outlet is connected to the one condensation channel so as to drain condensed water received from the one condensation channel into an interior of the dishwasher.

14. The dishwasher of claim 13, wherein the first and second water vapor inlets and the condensed water outlet are in communication with each other.

15. The dishwasher of claim 14, wherein some of the plurality of condensation ribs are downwardly inclined towards respective ends of the condensation panel.

16. The dishwasher of claim 15, wherein the lowermost of the plurality of condensation ribs is in communication with the water vapor inlet and the condensed water outlet.

17. The dishwasher of claim 16, wherein the plurality of condensation ribs are inclined so as to direct condensed water towards the condensed water outlet.

18. The dishwasher of claim 13, wherein at least one of the upper horizontal member or the lower horizontal member extends at an upward incline from an interior end toward an exterior end thereof, with an upward inclination angle of the lower horizontal member being greater than that of the upper horizontal member, and wherein at least one protrusion protrudes from the lower horizontal member.

* * * * *